US009144965B2

(12) United States Patent
Dim et al.

(10) Patent No.: US 9,144,965 B2
(45) Date of Patent: Sep. 29, 2015

(54) PRINT ARRANGEMENT

(75) Inventors: Yuval Dim, Moshav Haniel (IL); Yaron Dekel, Gan-Yeoshaya (IL); Yehuda Ben Abu, Netanya (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 958 days.

(21) Appl. No.: 12/770,148

(22) Filed: Apr. 29, 2010

(65) Prior Publication Data

US 2011/0265674 A1 Nov. 3, 2011

(51) Int. Cl.

| | |
|---|---|
| ***B41F 1/28*** | (2006.01) |
| ***B41F 13/02*** | (2006.01) |
| ***B41J 11/00*** | (2006.01) |
| ***B41J 15/16*** | (2006.01) |
| ***B65H 23/025*** | (2006.01) |

(52) U.S. Cl.

CPC ..... *B41F 13/02* (2013.01); *B41J 11/001* (2013.01); *B41J 15/16* (2013.01); *B65H 23/0251* (2013.01); *B65H 2301/51256* (2013.01); *B65H 2301/512422* (2013.01); *B65H 2404/1321* (2013.01); *B65H 2701/11312* (2013.01); *B65H 2801/36* (2013.01)

(58) Field of Classification Search

CPC B41F 1/28; B65H 2301/331; B65H 2301/33; B65H 2601/272; B65H 2404/1321

USPC ..... 226/18, 19, 21

See application file for complete search history.

(56) References Cited

U.S. PATENT DOCUMENTS

| | | | | |
|---|---|---|---|---|
| 3,147,898 | A | 9/1964 | Huck | |
| 3,774,271 | A | 11/1973 | Depuy et al. | |
| 4,888,717 | A | 12/1989 | Ditto et al. | |
| 5,021,673 | A * | 6/1991 | Dragon et al. | 250/548 |
| 5,383,393 | A * | 1/1995 | Ueda et al. | 101/220 |
| 5,676,477 | A * | 10/1997 | Tanaka et al. | 400/579 |
| 6,102,597 | A * | 8/2000 | Liberman | 400/636.3 |
| 6,125,754 | A * | 10/2000 | Harris | 101/420 |
| 6,144,832 | A * | 11/2000 | Nimura et al. | 399/328 |
| 6,250,220 | B1 | 6/2001 | Sainio et al. | |
| 6,837,635 | B1 | 1/2005 | Juan | |
| 2004/0178571 | A1 * | 9/2004 | Ohama et al. | 271/272 |
| 2004/0262837 | A1 * | 12/2004 | Hamada et al. | 271/272 |
| 2006/0023053 | A1 * | 2/2006 | Sasa et al. | 347/104 |
| 2006/0070840 | A1 * | 4/2006 | Hayashi et al. | 194/206 |
| 2006/0147232 | A1 | 7/2006 | Fuchs et al. | |
| 2008/0143032 | A1 * | 6/2008 | Liberman et al. | 270/1.01 |
| 2008/0181707 | A1 * | 7/2008 | Martin et al. | 400/579 |
| 2010/0005987 | A1 * | 1/2010 | Shapira | 101/407.1 |

FOREIGN PATENT DOCUMENTS

| | | | | |
|---|---|---|---|---|
| JP | 01242343 A * | 9/1989 | | B65H 5/06 |
| JP | 08225221 A * | 9/1996 | | B65H 29/70 |
| WO | WO 2004/035315 | 4/2004 | | |
| WO | WO 2008/093157 | 8/2008 | | |

* cited by examiner

*Primary Examiner* — David Banh

(57) ABSTRACT

Print arrangement, comprising a first roll, a transport surface, a nip between the first roll and the transport surface through which, at least during printing, a substrate is threaded, a drive system arranged to change a width of the nip, and a lateral stretch member arranged to engage a side of the substrate. The first roll comprises a two coaxially aligned roll segments of similar diameters for rolling over the substrate, with a distance in between.

20 Claims, 8 Drawing Sheets

PRINT ARRANGEMENT

BACKGROUND OF THE INVENTION

This disclosure relates to print arrangements and methods of printing. In print arrangements, especially large format printers, substrates are oftentimes transported by transport rolls. Two opposite rolls may form nips through which the substrate is transported. When printing on relatively large substrates, such as is the case in large format printing (LFP), it is important that the print head prints on an even printing surface of the substrate. Irregularities in the printing surface of the substrate such as undulations, wrinkles and folds may cause damage to the substrate and/or the printed image. In some exemplary cases, undulations and wrinkles may be formed because the substrate material is not homogenous or because of a misbalanced drive system. In other exemplary cases, the substrate may be poorly wound, poorly handled, or have a damaged surface or core. Consequently, small undulations may be pulled into the nip and cause irreparable damage to the substrate or disrupt the printing process. Moreover, the substrate may have an inclined position in the printer, causing undesirable deformations of the substrate or application of large margins. Therefore, irregularities in the surface and in the orientation of substrates, such as inclinations, undulations, wrinkles and folds, need to be prevented as much as possible.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description through modification, combination or variation of certain elements.

Furthermore, it may be understood that also embodiments or elements that may not be specifically disclosed in this disclosure may be derived from the description and drawings.

Figure 1:
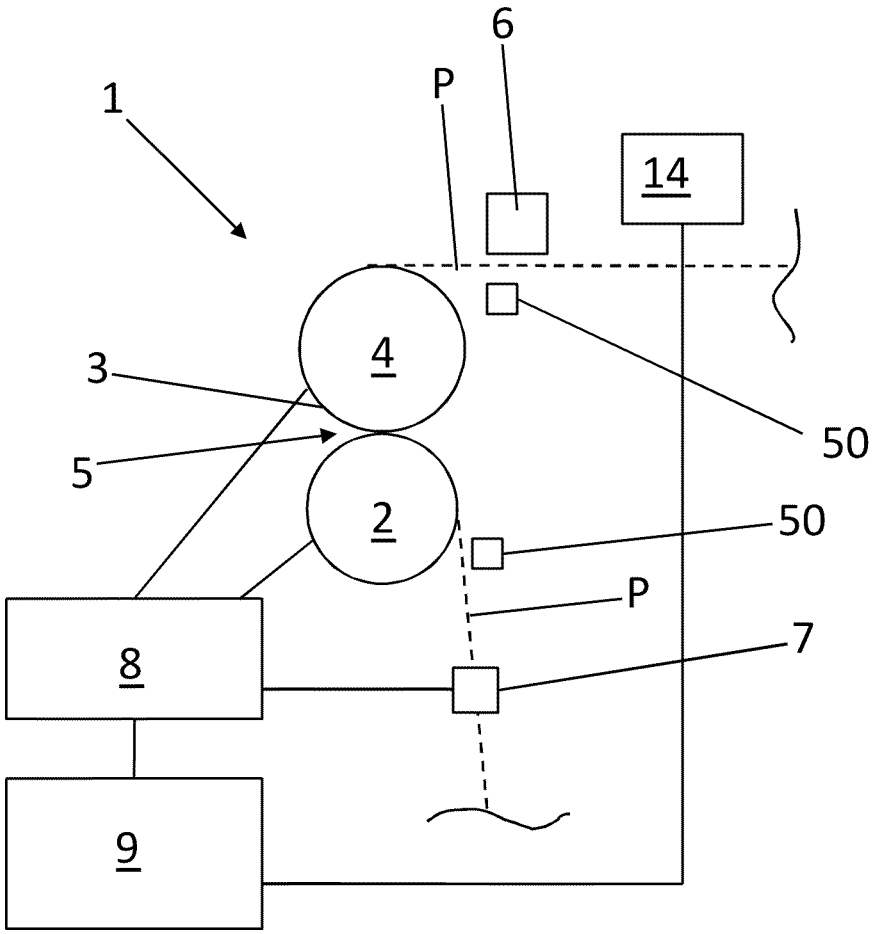
FIG. 1 shows a diagram of a side view of a portion of a print arrangement, according to an embodiment of this disclosure.

FIG. 1 shows a diagrammatic cross sectional view of a portion of a print arrangement 1. The print arrangement 1 may comprise a first roll 2 and a transport surface 3. The transport surface 3 may be the surface of a transport roll 4. The first roll 2 may comprise a pressure roll for pressurizing a substrate 27 against the transport surface 3. Between the first roll 2 and the transport roll 4, a nip 5 may be provided. During a printing action a substrate 27 may be transported by the rolls 2, 4, through the drive nip 5, along a print head 6. Also a substrate path P is shown, along which the substrate 27 is transported.

The first roll 2 may be arranged to pressurize the substrate 27 against the transport surface 3, to counter wrinkles and undulations in the substrate 27 and/or to contribute in the substrate's transportation and/or to achieve other effects. In an embodiment, the first roll 2 is referred to as first pressure roll but in this disclosure it will generally be referred to as first roll 2, as it may have other functions than mere pressurization. The first roll 2 may be arranged to induce a transverse stretch in the first roll 2 as will be explained in various sections of this disclosure.

Figure 7:
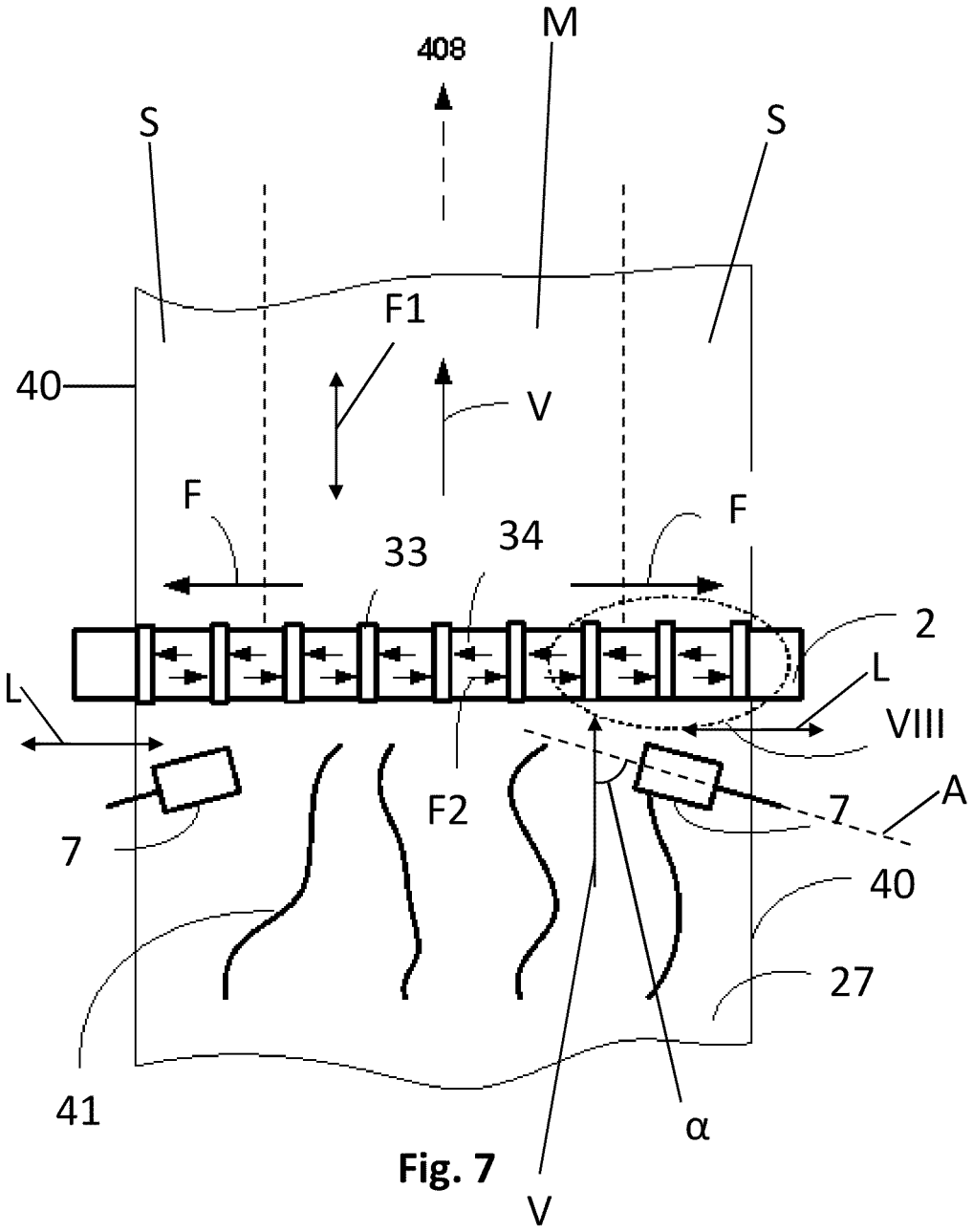
FIG. 7 shows a diagrammatic representation of a substrate moving along lateral stretch members and a pressure roll, wherein incoming undulations and force vectors are illustrated, according to an embodiment of this disclosure.

The print arrangement 1 may comprise at least one lateral stretch member 7 arranged to engage the substrate 27 near at least one side portion S of the substrate 27. The side portion S is indicated in FIG. 7. The side portions S refer to the respective portions of the substrate 27 that are relatively near to the side edges 40 of the substrate 27. Lateral stretch members 7 may be provided near both, opposite, sides of the substrate 27. Furthermore, the lateral stretch members 7 may comprise lateral stretch rollers 26. The lateral stretch members 7 may be arranged to stretch the substrate 27 in a transverse direction L. Furthermore, the lateral stretch members 7 may be arranged to adjust an angle of the substrate 27 with respect to the intended moving direction V. The combination of a first roll 2 and lateral stretch members 7 may keep the substrate 27 relatively evenly tensioned in the transverse direction.

A drive system 8 may be provided for driving the transport roll 4 and/or the first roll 2. In an embodiment the drive system 8 may be arranged to vary the width of the drive nip 5. For example, the drive system 8 may be arranged to reset a height or location of the first roll 2 with respect to the transport roll 4 to vary a pressure onto the substrate 27. The drive system 8 may be arranged to move the lateral stretch members 7, for stretching the substrate 27 and/or for adjusting an inclination of the substrate 27 with respect to the intended moving direction. A controller 9 may be provided to control the drive system 8 by driving the respective print arrangement components.

Figure 2:
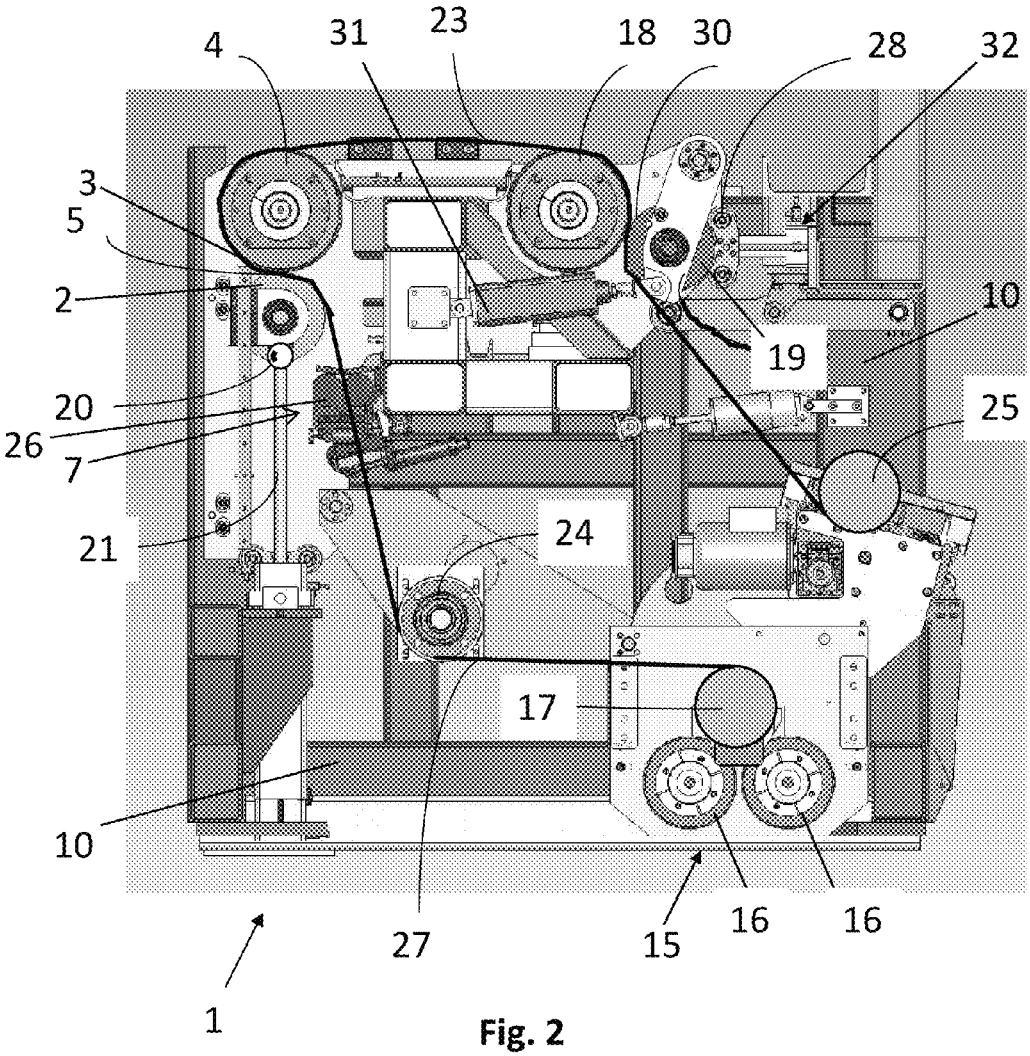
FIG. 2 shows a schematic cross sectional side view of a print arrangement, according to an embodiment of this disclosure.
Figure 3:
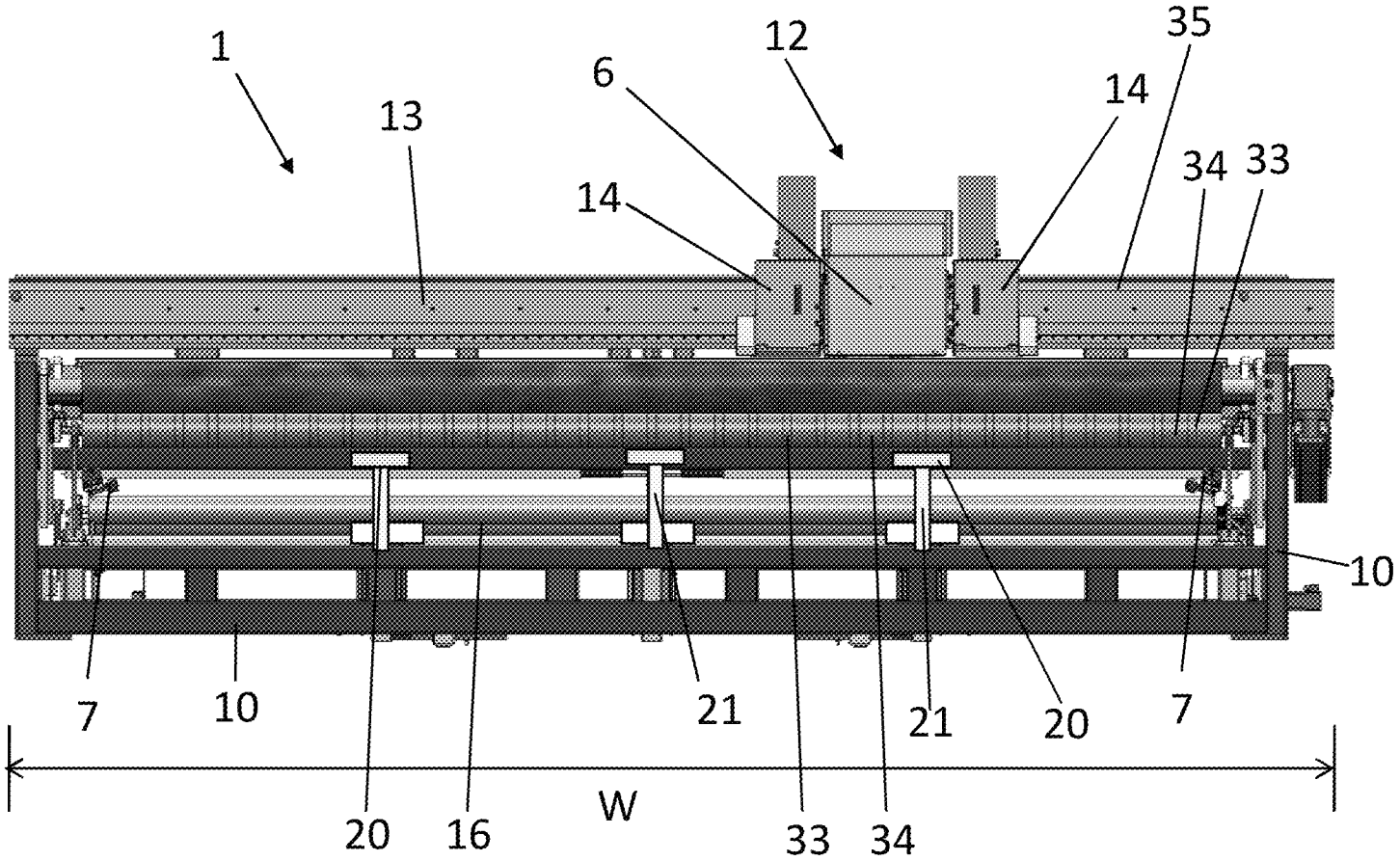
FIG. 3 shows a schematic front view of a print arrangement, according to an embodiment of this disclosure.

FIG. 2 shows a schematic cross sectional side view of an embodiment of the print arrangement 1. FIG. 3 shows a schematic cross sectional front view of a print arrangement 1, similar to the embodiment of FIG. 2. The print arrangement 1 may be large format printer, for example for processing print substrate rolls 17 having widths of four meters or more. Accordingly, the print arrangement 1 may have a width W of at least four meters, for example at least five meters. The print arrangement 1 may comprise an inkjet printer.

The print arrangement 1 may have rigid frame 10. The frame 10 may moveably support a print head 6, which may be movably arranged on a moveable carriage 12 on linear guides 13 (FIG. 3). The print arrangement 1 may comprise a radiation source 14 for curing ink. The radiation source 14 may comprise a UV radiation source and/or other types of heating, curing, radiating and/or drying sources. The radiation source 14 may be mounted on the carriage 12, for example on both sides of the print head 6. In use, the radiation source 14 may move together with the print head 6. In an embodiment, the print head 6 and/or the radiation sources 14 may be fixed/static elongated devices arranged along the width of the print arrangement 1 and/or substrate 27.

Suitable radiation sources 14 may include UV lamps with hot or cold mirrors, LEDs or any other suitable radiation sources known in the art. The UV radiation source may be operated in a continuous or flash mode of operation.

Suitable ink drying sources may include IR lamps, resistive heat emitters, and/or other heat emitting sources capable of providing a sufficient amount of energy required to dry the solvent or water of the ink. The drying radiation source may be operated in a continuous mode of operation.

In operation the print head 6 may reciprocate over the printing substrate 27 and may eject droplets of ink onto the substrate 27. Before and/or after one or more print head strokes the substrate 27 may be advanced in a stepwise manner wherein the advance distance may be equal to a printhead swath height.

The frame 10 supports several components as can be seen from FIG. 2. A substrate supply arrangement 15 may comprise one or more substrate support rolls 16 for supporting a substrate supply roll 17. The print arrangement 1 may further comprise a second transport roll 18, as shown in FIG. 2. In an embodiment, the first roll 2 may comprise a first pressure roll, associated with the first transport roll 4. Likewise, the second transport roll 18 may be associated with a second roll, or pressure roll 19. The second roll 19 may be arranged to apply a pressure and/or back tension to the substrate 27, with a corresponding second nip 30 between the second transport roll 18 and the second pressure roll 19. In an embodiment, the first and second rolls 2, 19 may rotate freely. The drive nip 5 and the second nip 30 may together control the tension in the substrate 27, wherein resetting the drive nip 5 may periodically release the tension.

Between the first and second transport rolls 4, 18 a support surface 23 may be provided for supporting the substrate 27. The support surface 23 may support the substrate 27 during printing. The support surface 23 may for example be flat or curved. The print head 6 may be arranged above the support surface 23.

Furthermore a third transport roll 24 may be provided, which may function as a brake roll. The third transport roll 24 may aid in tensioning the substrate 27. The third transport roll 24 may prevent free unwinding of the supply roll 17, for example when the drive nip 5 is open. A collection roll 25 may be provided for collecting the printed substrate 27 at the end of the substrate movement path P.

At least one first pressure drive roll 20 may be provided for engaging the first roll 2. In the shown embodiment, a series of three pairs of first pressure drive 2 rolls 20 may be provided for engaging the first roll 2. The number of first pressure drive rolls 20 may depend on the width of the print arrangement 1. The one or more first pressure drive rolls 20 may be mounted on at least one actuator 21, such as a pneumatic or other type of piston. In the shown embodiment of FIG. 3, the first pressure drive rolls 20 are withdrawn with respect to the first roll 2. The first pressure drive rolls 20 may be mounted on an intermediate bracket that supports a pair of first pressure drive rolls 20. When in operation the actuators 21 may move the respective first pressure drive roll 20, until the first pressure drive roll 20 applies a force towards the first roll 2 through a rolling contact directly against the surface of the first roll 2. In this way setting a drive nip width may be set, and the substrate 27 may be pressurized and stretched by the first roll 2. The pressure on the substrate 27 may be completely or partially released by resetting the drive nip width.

Also second pressure drive rolls 28 may be provided. The second pressure drive rolls may be clamping rolls. The second pressure drive rolls 28 may be arranged to supporting the second roll 19. The second pressure drive rolls 28 may be arranged to exert a pressure onto the second roll for pressurizing the substrate 27 between the second transport roll 18 and the second roll 19. The second pressure drive rolls 28 may be arranged to reset a width of the second nip 30. A second actuator 31 may be provided for moving the second roll 19. In the shown embodiment, the second actuator 31 may directly move the second roll 19 for resetting the second nip width. In the shown embodiment, the second pressure drive rolls 28 may exert a continuous pressure against the second roll 19, for example by resilient means 32, to exert a pressure in the direction of the second transport roll 18.

The first transport roll 4 and its associated first roll 2, and/or the other rolls 16, 17, 24, 18, 20, 19, 28, 25 may be arranged in parallel in the print arrangement. In an embodiment, the lateral stretch rolls 26 may be inclined with respect to the other parallel rolls 2, 4, 16, 17, 24, 18, 20, 19, 28, 25. The transport rolls 4, 18, 24 and the respective pressure rolls 2, 19, and/or other rolls may span at least the width of the substrate 27 on which printing is to be performed. For example, the substrate may be 5 meters wide and the respective rolls 2, 4, 16, 17, 24, 18, 20, 19, 28, 25 may be of a similar width or wider.

In an embodiment, the substrate 27 is threaded through along the substrate feed path P, for example starting at a substrate supply roll 17 that stores the substrate 27, then along the third transport roll 27, through the drive nip 5 formed by first transport roll 4 and the associated first roll 2, then over the support surface 23, where the printing may take place, then the second nip 30, between the second transport roll 18 and the second roll 19. The printed substrate 27 may be collected on a collection roll 25 (see FIG. 2), or collected as a free-fall substrate The actuator 21 may move the first pressure drive rolls 20 for changing the width of the drive nip 5. The width of drive nip 5 may vary from zero to any suitable width, which may be equal to or larger than the substrate thickness. Variation in the position of pressure drive roll 20 may move the first roll 2 in the direction of the first transport roll 4, for example to vary the width of drive nip 5. Hence, the substrate back tension may change. In certain embodiments, the back tension may be completely released by increasing the width of the drive nip 5. In this disclosure, the substrate back tension may refer to the tension in the substrate 27 upstream of the drive nip 5.

The first and/or second actuator 21, 31 may comprise any type of piston, for example pneumatic or hydraulic. The first and/or second actuator 21, 31 may also comprise an electro motor, or any other suitable actuating means.

Figure 4:
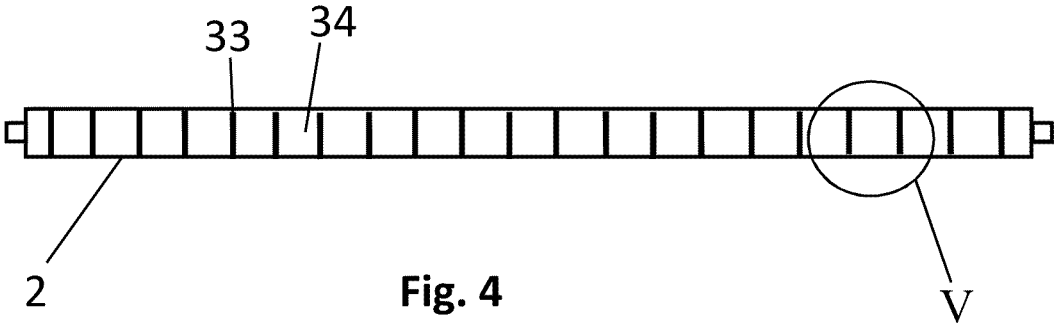
FIG. 4 shows a schematic front view of an embodiment of pressure roll.
Figure 5:
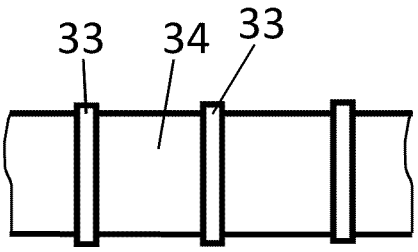
FIG. 5 shows a more detailed schematic front view of a portion of the pressure roll of FIG. 4.

As can be seen from, FIGS. 3-5, the first roll 2 may comprise at least two, coaxially aligned, first roll segments 33. The rotation axis of the first roll segments 33 may extend in a transverse direction L (FIG. 7) with respect to the substrate moving direction V. The coaxially aligned roll segments 33 may be distanced. In the shown embodiment, second roll segments 34 may be provided between the first roll segments 33. The first roll segments 33 may exert pressure onto the substrate 27. The first roll segments 33 may induce a transverse tension in the substrate 27, i.e. a tension perpendicular to the direction of movement of the substrate 27. The tension may be induced next to the first roll segments 33. The first roll segments 33 may be provided along the width of the print arrangement to provide the transverse tension over the entire width of the substrate 27. In an embodiment, the first roll segments 33 may be provided at least near a middle portion M of the substrate 27 (see FIG. 7), wherein the middle portion M refers to the area of the substrate 27 that extends between the side portions S. Further transverse tension in the substrate 27 may be provided by the lateral stretch members 7, that are arranged upstream of the substrate 27 with respect to the first roll 2.

The first roll 2 may comprise multiple coaxially and intermittently arranged first and second roll segments 33, 34, arranged along approximately the full width of the substrate 27. The second roll segments 34 may have a reduced diameter with respect to the neighboring first roll segments 33.

In an embodiment, the second segments 34 may be produced by selectively machining the first roll 2 to a smaller diameter. In a further embodiment, the first segments 33 having a larger diameter may be manufactured by connecting material such as strips, tape or paint to the first roll 2. The difference between the larger diameter segments and the smaller diameter segments may be between approximately 0.1 and approximately 0.5 millimeter, for example between approximately 0.1 and approximately 0.3 mm. The first segments 33 may be equidistantly spaced along the first roll 2.

The first segments 33 may be narrower than the second segments 34, for example for facilitating a relatively wide area of transverse stretch in the substrate 27. The second segments 34 may be at least 0.02 millimeter wider than the first segments 33, or at least 1 millimeter, or at least 5 millimeter, or approximately one or several centimeters. In other words the distance between neighboring first segments 33 may be bigger than the width of the first segments 33. The width of the first segments 33 may for example be determined by the width of the tape. The distance between neighboring first segments 33 may be determined by experiments and may vary between print arrangements 1 and first rolls 2.

The substrate 27 may be threaded between the transport roll 4 and the first roll 2. The transport roll 4 may pull the substrate 27 from the substrate supply roll 17 and transport the substrate 27 in the moving direction V, which may be oriented along the largest substrate dimension and along the substrate feed path P.

Figure 6:
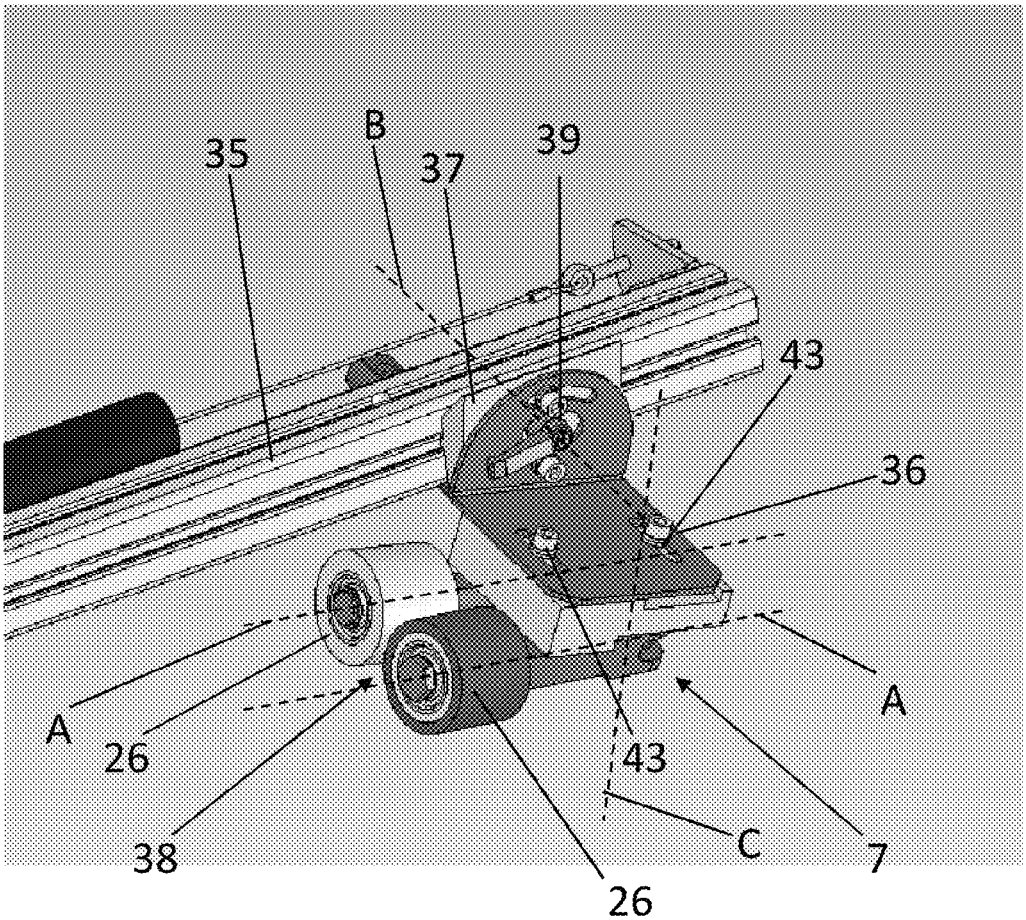
FIG. 6 shows a schematic perspective view of embodiments of a lateral stretch member and a guide of the lateral stretch member shown in FIG. 3.

As can be seen from FIGS. 3 and 6, the print arrangement 1 may comprise a guide 35 to which the lateral stretch members 7 may be re-positioned. The guide 35 may be arranged in a transverse direction with respect to the substrate moving direction V (FIG. 7). The guide 35 may be arranged parallel to the transport rolls 4, 18, 24 and the first and second rolls 2, 19, respectively.

The lateral stretch member 7 may comprise two lateral stretch rolls 26 through which a substrate 27 may be threaded. The lateral stretch rolls 26 may be arranged in parallel to each other, forming a nip 38 in between, herein referred to as side nip 38. The lateral stretch rolls 26 may each comprise an axle A. The axles A may be parallel to each other. In an embodiment, the parallel axles A may be arranged parallel to the substrate 27.

The lateral stretch member 7 may be arranged to reset the width of the nip 38. The width of the nip 38 may be reset by moving at least one lateral stretch roll 26 with respect to the corresponding lateral stretch roll 26. The lateral stretch member 7 may comprise a nip resetting structure (not shown). The nip resetting structure may comprise pneumatic or hydraulic actuators or for example an electro motor.

The nip resetting structure may also comprise a manual nip resetting structure. For example, the bracket 36 may comprise the nip resetting structure. The nip resetting structure may comprise a roll guide 43 for resetting a position of the respective roll 26 with respect to the bracket 36 and/or with respect to each other. The roll guide 43 may comprise a slot and/or a sliding element, wherein the sliding element may be arranged to be guided in the slot. A screw or the like may be provided for locking a respective lateral stretch roll with respect to the bracket 36.

The lateral stretch member 7 may comprise a bracket 36. The bracket 36 may be mounted on the guide 35. The bracket 36 may be arranged to be re-positioned in the transverse direction, along the guide 35. For example, the bracket 36 may comprise a slide 37 for being slit along the guide 35. The guide 35 may comprise a corresponding slot for receiving the slide 37. The bracket 36 may be arranged to be tightened to the guide 35, for example by screws or other tightening means.

The bracket 36 may be arranged to allow re-setting an angle $\alpha$ of the lateral stretch rolls 26 with respect to the substrate moving direction V for changing the transverse tension in the substrate 27 (FIG. 7). The bracket 36 may comprise an angle resetting element 39 for resetting said angle $\alpha$. The bracket 36 may be arranged to rotate around a rotation axis B, for resetting the angle $\alpha$, as shown in FIG. 6. The angle resetting element 39 may comprise an axle, with rotation axis B, and comprising a screw thread for fixing the angle $\alpha$ of the lateral stretch rolls 26. In a further embodiment, the lateral stretch rolls 26 may be rotated around a third axis C that may be perpendicular to said rotation axis B. The third axis C may also be perpendicular to the parallel rotation axles A of the wheels. Rotation around the third axis C may result in the lateral stretch roll axles A being turned in a non-parallel position with respect to the substrate 27 that is at that moment threaded through the rolls 26. This may result in a stretching force near the sides of the respective substrate 27.

In another embodiment, the lateral stretch rolls 26 are arranged to have a fixed angle $\alpha$ with respect to the substrate moving direction V (FIG. 7). For example, the angle $\alpha$ of the lateral stretch rolls 26 with respect to the moving direction V may be approximately 30°, for example between approximately 10° and approximately 50°, or between approximately 20° and approximately 40°. These angles $\alpha$ may determine and/or affect the transverse tension in the substrate 27.

In an embodiment, resetting the angle $\alpha$ of the roll axles A with respect to the substrate moving direction V may affect the transverse tension in the substrate 27. In another embodiment, resetting the nip width of the lateral stretch member 7 may affect and/or determine the transverse tension in the substrate 27.

Furthermore, an inclination of the substrate 27 with respect to the substrate moving direction V, or the desired substrate moving direction V, may be adjusted by resetting the angle $\alpha$ and/or the side nip width of one lateral stretch member 7 with respect to the opposite lateral stretch member 7. The nip width and/or angle $\alpha$ may be adjusted to prevent tumbling and/or skewing of the substrate 27. In one embodiment, the angle $\alpha$ of the lateral stretch rolls 27 with respect to the substrate moving direction V may be predetermined, while the respective nip widths between the lateral stretch rolls 26 may be reset according to a desired tension and/or skew adjustment.

In certain embodiments, the lateral stretch member 7 may comprise other guide members than rolls 26 that are arranged to change a tension and/or inclination of the substrate 27. For example, the lateral stretch member 7 may comprise blocks or slides for engaging the substrate 7 for achieving a similar effect.

The lateral stretch rolls 26 may engage margins near the sides of the substrate 27 threaded between the rolls 26. Transverse stretching may occur when the rolls 26 are inclined with respect to the substrate moving direction V, while engaging the substrate 27 threaded between them. The transverse stretching force F may be varied by moving the lateral stretch rolls 26 within one lateral stretch member 7 with respect to each other.

The stretching forces F on the side portions S applied by the lateral stretch members 7 may be approximately equal, for example by setting an equal side nip width and/or an equal angle α and/or an equal engagement position with respect to the side edges 40 of the substrate 27 for both lateral stretch members 7. In a further embodiment, the nip width of one lateral stretch member 7 may be set to be different from the nip width of the opposite lateral stretch member 7. This may result in a change of a substrate angle with respect to the moving direction V. For example, such substrate angle with respect to the moving direction V may be corrected to keep the substrate 27 in a relatively straight position with respect to the moving direction V, in other words, to prevent substrate tumbling. Also the angle α and/or the engagement position of one lateral stretch member 7 may be different from the respective angle and/or engagement position of the opposite lateral stretch member 7. This may also result in a correction and/or change of the substrate angle with respect to the moving direction V. Hence, there are multiple ways of resetting one lateral stretch member 7 with respect to the opposite lateral stretch member 7 for changing an inclination of the substrate 27 with respect to the moving direction V.

Figure 8:
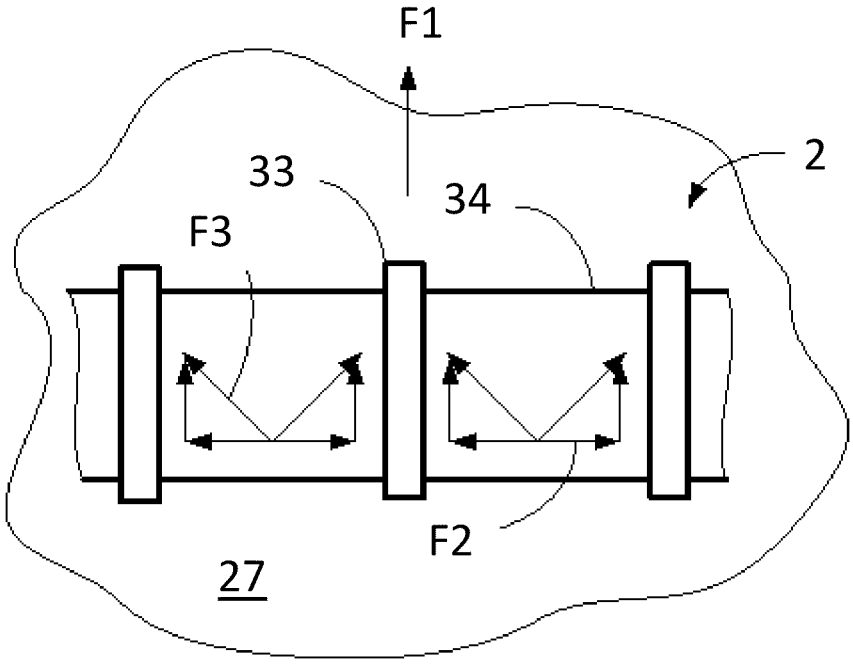
FIG. 8 shows a portion of the pressure roll and substrate of FIG. 7, as well as forces resulting from the pressure roll and the transport rolls.

FIGS. 7 and 8 schematically show force vectors applied to, and resulting in, the substrate 27 of an embodiment of this disclosure, wherein a substrate 27 with wrinkles 41 is fed into the print arrangement 1. The second transport roll 18 may constantly apply a tensioning force F1 in the direction of movement V, with respect to the first and/or third transport roll 4, 24, represented by a force vector F1. As shown in FIG. 8, the first segments 33 may apply a pressure to the substrate 27, for example resulting in a transverse tension as represented by force vectors F2. The force vector F2 may have a relatively wide angle, for example approximately perpendicular, with respect to the first tension force F1 and the substrate moving direction V. A force vector F3 may be a sum of said two force vectors F1, F2.

The first tension force F1, the transverse force F2 and/or the sum of said forces F3 may stretch the substrate 27. Without being bound to any theory, it may be that the transverse force vector F2 may contribute in stretching wrinkles, that may have remained after a first transverse stretch action performed by the lateral stretch members 7, at substrate areas corresponding to the second segments 34. The transverse force vectors F2 imposed by the first segments 33 and the summed force vectors F3 may remove wrinkles that may be present in the substrate 27.

The drive system 8 may be arranged to drive the respective actuators 21, 31, and/or the transport rolls 4, 18, 24. In an embodiment, the drive system 8 may be arranged to reset the settings of the lateral stretch member 7. For example, the controller 9 may signal the drive system 8 to change the angle α and/or nip width of the lateral stretch member 7. In an embodiment, the inclination of the substrate 27 with respect to the substrate moving direction V may be corrected by an operator, or automatically with the aid of sensors, for example substrate edge detection sensors. For automatically controlled lateral stretch members 7, signals received from a sensor may be compared to one or more threshold values corresponding to certain preset tolerances with respect to the inclination of the substrate 27 with respect to the substrate moving direction V. By comparison of the sensor signals with the threshold values the substrate inclination may be compensated by driving the respective lateral stretch member 7 and/or stretch members 7. In another embodiment, the controller 9 may signal an operator interface for signaling an operator to adjust the lateral stretch member settings 9.

Furthermore, the controller 9 may control the operation of the respective radiation sources 14. The controller 9 may be configured to activate the radiation source 14 to increase radiation when the tension in the substrate 27 is lowered, wherein the lowered tension corresponds to a change in the output of the drive system 8. For example, the radiation source 14 may be turned on when the drive nip 5 is opened for releasing the tension exerted by the first transport roll 4. For example, the controller 9 may control the respective actuators 21 and/or 31 to apply and release a pressure to the substrate 27 through actuating the respective first and/or second roll 2, 19. The pressure may be applied and released in respective intervals. During a release period, or at least a period of lower tension in the substrate 27, the controller 9 may signal the radiation source 14 to radiate, for example for curing ink during a pressure release period. The radiation source may include UV, IR and/or other heating and/or lighting sources, which may be selectively controlled.

Figure 9:
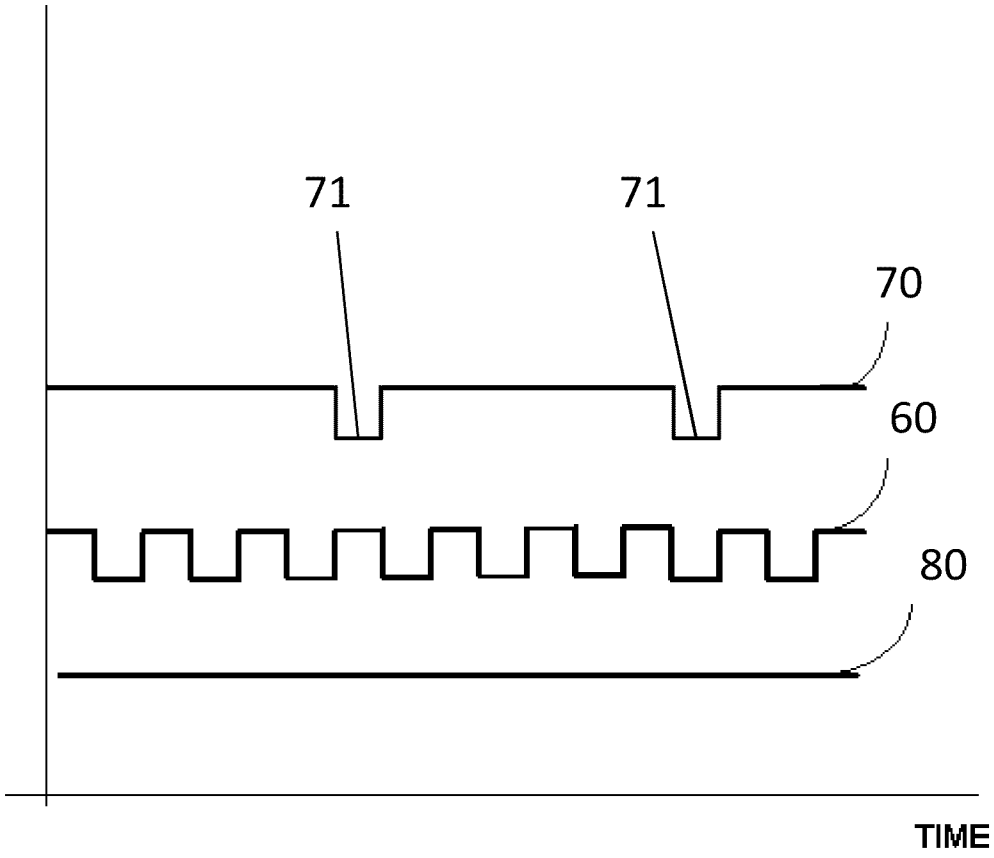
FIG. 9 shows a graph of a first transport roll torque, a substrate pressure applied by the first pressure roll, and a transverse stretch tension force applied by the lateral stretch members, respectively, on a vertical axis, and time on a horizontal axis, according to an embodiment of this disclosure.

In operation, the first transport roll 4 may be rotated at a first speed. The first transport roll 4 may rotate in a step wise manner, as shown by numeral 60 in FIG. 9. The graph 60 may correspond to a stepwise increasing and decreasing torque or speed of the first transport roll 4. At each rotation, the substrate 27 may be pulled off the supply roll 17. The stepwise rotation may correspond to one or more strokes of the print head 6. A step may correspond to a swath height of the print head 6.

The second transport 18 may rotate at a second speed, different from the first speed. The second rotation speed may be higher than the first rotation speed and the difference in the speeds may generate the tension (back tension) force F1 in the substrate portion that is located between the first and second transport roll 4, 18. It will be appreciated that in another embodiment said transport rolls 4, 18 could have substantially different diameters, and the same angular velocity, but for example different circumferential speeds at the point of contact with the web, so as to cause a tension even when rotating at the same velocity.

In an embodiment, the tension in the substrate 27 may be periodically released. For example, undesired undulations in the substrate 27 may be removed by varying and/or relieving the drive of substrate 27 from time to time, for example periodically or occasionally, as shown by numeral 70 in FIG. 9. This may be achieved by correspondingly opening and closing the nip 5. In the graph, a release action is indicated by 71. This effect may be enhanced by continuously stretching the substrate 27 with the lateral stretch members 7, as shown by reference numeral 80. In this example, a continuous transverse stretch may be applied, while the second transport roll 18 applies and periodically releases tension and the drive nip 5 is periodically opened and closed.

The temporary and periodical release of the substrate 27 in the drive nip 5 may reduces the drive force, which may allow the undulations 41 to smoothen with the aid of the second transport roll 18. In one embodiment the tension may be fully released so that the pressure drive roll 20 does not urge the first roll 2 to force the substrate 27 into pressured contact with the first transport roll 4. In some embodiments the distance between the first transport roll 4 and the first roll 2 may be significantly wider than the thickness of the substrate 27 so as to allow relatively free movement of the web substrate over the first transport roll 4.

The transverse stretching of the substrate 27 by the lateral stretching members 7, inducing the transverse stretching forces F may also smoothen undulations 41, for example in the periods when the drive nip 5 is open. The transverse forces F2 induced by the first roll 2 may further assist in undulations removal. Each of the forces F1, F2, F3 may operate alone or in combination to smoothen or eliminate wrinkles 41 so as to achieve an even substrate surface.

Amongst others, the print arrangement 1 and its aspects as discussed in this disclosure has shown to place less stringent mechanical accuracy requirements on the print arrangement architecture and/or may simplify the design of the print arrangement 1 while allowing better control of the orientation and surface properties of the substrate 27.

In a first aspect, a print arrangement 1 may be provided, having a first roll 2, a transport surface 3, a nip 5 between the first roll 2 and the transport surface 3 through which, at least during printing, a substrate 27 is threaded, a drive system 8 arranged to change a width of the nip 5, and a lateral stretch member 7 arranged to engage the side S of the substrate 27, wherein the first roll 2 comprises a two coaxially aligned roll segments 33 of similar diameters for rolling over the substrate 27, with a distance in between, for inducing a stretch in the substrate 27, at least between the two roll segments 33, in a direction L transverse with respect to a substrate moving direction V and at least near a middle portion M of the substrate 27. The first roll 2 may be a pressure roll for pressurizing the substrate 27 against the transport surface 3.

In an embodiment, the drive system 8 comprises an actuator 21, 31. The controller 9 may be arranged for driving the actuator 21, 31 for stretching the substrate 27 in at least a transverse direction with respect to the substrate moving direction V.

In a further aspect, a method of maintaining an even substrate surface may be provided. Such method may be aimed at preventing or eradicating wrinkles, undulations or the like in the substrate 27. In such method, a substrate 27 may be fed to a print arrangement 1. The substrate 27 may be moved by rotating at least one roll, for example the first transport roll 4. The substrate 27 may be stretched in a transverse direction L with respect to the substrate 27 moving direction by (i) applying a stretching force to a side portion S of the substrate 27 so that the substrate 27 is transversely stretched, and (ii) rolling two co-axially arranged roll segments 33 with a distance in between and of similar diameters over a middle portion M of the surface of the substrate 27 so that the substrate portion between the two roll segments is transversely stretched, and (iii) printing the substrate 27. In an embodiment, transverse stretching near the side portions S is performed by the lateral stretch members 7.

In a further embodiment, an inclination of the substrate 27 may be measured, and a stretch force F may be applied near one side of the substrate 27 that may be different than a stretch force F on the other side of the substrate 27 so that the inclination of the substrate 27 changes until a desired inclination of the substrate 27 is measured. Also, a pressure may be applied to the surface of the substrate 27, for example over substantially the whole width of the substrate 27, by rolling multiple co-axially arranged roll segments 33, 34 having first and second diameters over the substrate 27, the first diameter being smaller than the second diameter.

In a further aspect, a print substrate stretch arrangement may be provided. The print substrate stretch arrangement may include (i) transport rolls 4, 18, 24 for transporting the substrate 27 for printing, (ii) at least one pressure roll 2, (iii) a nip 5 between the pressure roll 2 and a respective transport roll 4 through which, at least during printing, a substrate 27 is threaded. The pressure roll 2 may include intermittently and co-axially arranged first and second roll segments 33, 34, the first roll segments 33 having a larger diameter than the second roll segments 34 for inducing a stretch in the substrate 27 in a direction transverse with respect to the substrate moving direction, and opposite lateral stretch members 7, each arranged to engage a respective side portion S of the substrate 27.

It is clear that in the shown embodiments, the transport surface 3 may be the surface of the transport roll 4. In the shown embodiments, the transport roll 4 may drive the substrate movement. In other embodiments, the transport surface 3 may for example be a support surface over which the substrate is slit, wherein the nip 5 may be formed between that support surface and the first roll 2.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

The mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. A print arrangement, comprising:

a first roller;

a transport surface forming a nip between the transport surface and the first roller, the transport surface to transport a substrate in a moving direction, the substrate to be threaded through the nip;

lateral stretch members positioned to engage opposite transverse side portions of the substrate, longitudinal axes of the lateral stretch members being non-perpendicular relative to the moving direction to enable a force to be applied to the respective side portions of the substrate in a direction transverse to the moving direction within a plane of the substrate, the lateral stretch members being separately settable between different substrate engagement positions to enable an angle of skewing of the substrate to be adjusted relative to the moving direction, the longitudinal axes of the lateral stretch members being non-parallel relative to a longitudinal axis of the first roller; and a guide arranged in a transverse direction relative to the moving direction, a first lateral stretch member of the lateral stretch members including a bracket carried by the guide and lateral stretch rollers carried by the bracket to form a side nip between the lateral stretch rollers.

2. The print arrangement of claim 1, wherein the first roller includes multiple coaxially and intermittently arranged first and second roller segments, the first roller segments having a larger diameter than the second roller segments.

3. The print arrangement of claim 1, wherein the bracket is re-locatable along the guide in the transverse direction.

4. The print arrangement of claim 1, wherein the lateral stretch member is settable by rotating the lateral stretch rollers.

5. The print arrangement of claim 1, wherein the lateral stretch member is settable by adjusting a width of the side nip.

6. The print arrangement of claim 1, wherein the first roller is a pressure roller to press the substrate against the transport surface.

7. The print arrangement of claim 1, further including an actuator to move the first roller to adjust a width of the nip between the first roller and the transport surface.

8. The print arrangement of claim 7, wherein the actuator includes a pneumatic actuator.

9. The print arrangement of claim 1, wherein the transport surface is a surface of a first transport roller.

10. The print arrangement of claim 9, further including a second transport roller, the first transport roller and the second transport roller being drivable at different speeds to provide a tension in the substrate.

11. The print arrangement of claim 10, further including a support surface between the first transport roller and the second transport roller to support and guide the substrate while printing.

12. The print arrangement of claim 10, further including a pressure roller to press the substrate against the second transport roller.

13. The print arrangement of claim 12, further including an actuator to move the second pressure roller relative to the second transport roller to adjust a width of a third nip between the second pressure roller and the second transport roller.

14. The print arrangement of claim 13, wherein the actuator includes a pneumatic actuator.

15. A method to operate a print arrangement, the method comprising:

operating a transport surface to move a substrate within the print arrangement in a travel direction;

separately setting lateral stretch members between different substrate engagement positions, the lateral stretch members being positioned to engage opposite transverse side portions of the substrate, longitudinal axes of the lateral stretch members being positioned at a non-perpendicular angle relative to the travel direction to apply a transverse force to the respective side portions of the substrate in a direction transverse to the travel direction and within a plane of the substrate; and operating the lateral stretch members concurrently with operation of the transport surface to adjust an angle of skewing of the substrate relative to the travel direction as the substrate moves.

16. The method of claim 15, wherein setting a first one of the lateral stretch members includes rotating two substantially parallel lateral stretch rollers of the first one of the lateral stretch members.

17. The method of claim 15, wherein setting the lateral stretch members includes setting a width of a nip between two substantially parallel lateral stretch rollers of the first one of the lateral stretch members.

18. The method of claim 15, wherein operating the transport surface includes applying pressure substantially over an entire width of the substrate by rolling a pressure roller over a portion of the substrate that is in a nip formed between the pressure roller and the transport surface, the pressure roller including multiple coaxially and intermittently arranged first and second roller segments, the first roller segments having a larger diameter than the second roller segments.

19. The method of claim 15, further including periodically applying and releasing tension in the substrate.

20. The print arrangement of claim 1, wherein the longitudinal axes of the lateral stretch members are positioned at between about thirty degrees and fifty degrees relative to the moving direction.

* * * * *